United States Patent [19]

Morgan

[11] Patent Number: 4,574,506

[45] Date of Patent: Mar. 11, 1986

[54] TENSIONING OF FLEXIBLE SHEETS ACROSS FRAMES

[75] Inventor: James N. Morgan, London, England

[73] Assignee: Marler Haley Exposystems Limited, England

[21] Appl. No.: 582,630

[22] Filed: Feb. 22, 1984

[30] Foreign Application Priority Data

Feb. 22, 1983 [GB] United Kingdom ..... 8304915

[51] Int. Cl.[4] ..... G09F 17/00

[52] U.S. Cl. ..... 40/603; 40/605; 40/21 R; 160/378; 160/381; 350/117

[58] Field of Search ..... 40/603, 21 R, 605; 160/371, 378, 381, 329, 328, 377, 376, 374.1, 372, 24, 25, 27, 28, 38, 39; 248/160, 407–409, 411, 413; 350/117, 124, 127

[56] References Cited

U.S. PATENT DOCUMENTS

| | | | |
|---|---|---|---|
| 699,007 | 4/1902 | Park | 160/381 |
| 1,960,632 | 5/1934 | Jackman | 160/378 |
| 2,072,754 | 3/1937 | Jones | 40/603 |
| 2,127,930 | 8/1938 | Osborn | 40/603 |
| 2,323,699 | 7/1943 | Babros | 160/381 |
| 2,368,099 | 1/1945 | Bodde | 350/117 |
| 2,403,661 | 7/1946 | Hurley | 160/378 |
| 2,645,540 | 7/1953 | Trimble et al. | 160/378 |
| 3,037,311 | 6/1962 | Ross et al. | 40/21 R |
| 3,080,166 | 3/1963 | Clark | 40/603 |
| 4,103,445 | 8/1978 | Smith et al. | 40/603 |
| 4,106,852 | 8/1978 | Chasins | 350/117 |
| 4,210,191 | 7/1980 | Li | 160/378 |
| 4,459,773 | 7/1984 | Sandlin et al. | 40/603 |

FOREIGN PATENT DOCUMENTS

| | | | |
|---|---|---|---|
| 558342 | 9/1932 | Fed. Rep. of Germany | 40/603 |
| 2237485 | 2/1975 | France | 160/378 |
| 158142 | 2/1921 | United Kingdom | 350/117 |
| 223989 | 11/1924 | United Kingdom | 160/378 |
| 1553930 | 10/1979 | United Kingdom | 40/605 |

*Primary Examiner*—Gene Mancene
*Assistant Examiner*—James Hakomaki
*Attorney, Agent, or Firm*—Banner, Birch, McKie & Beckett

[57] ABSTRACT

In a display or the like device, a flexible sheet is supported in tension within a frame by means of tensioning devices secured to the frame. Each tensioning device includes a movable peg which is engaged in an aperture in the sheet. Each peg can be placed in a position nearer the middle of the space within the frame in which it is retained, or displaced away from the middle of this space, to tension the sheet, and when so displaced, the peg is urged resiliently away from the middle of this space by a spring within the respective tensioning device, to hold the sheet in tension. The tensioning devices thus constitute a simple and compact means of providing for ready interchangability of various display areas in the frame.

7 Claims, 8 Drawing Figures

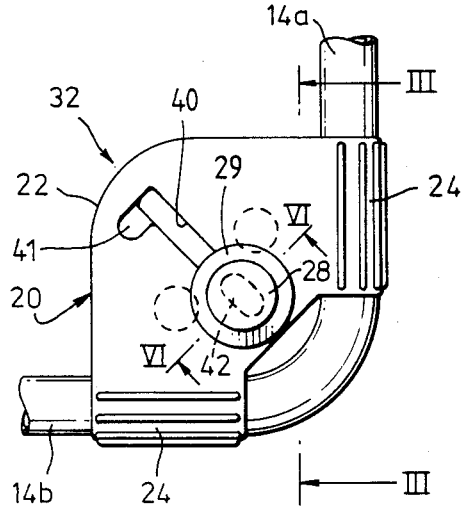
Fig. 2.
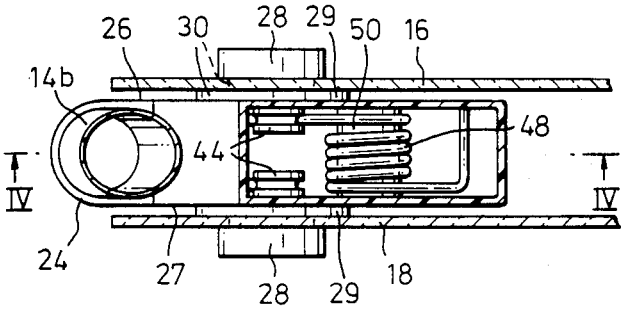
Fig. 3.
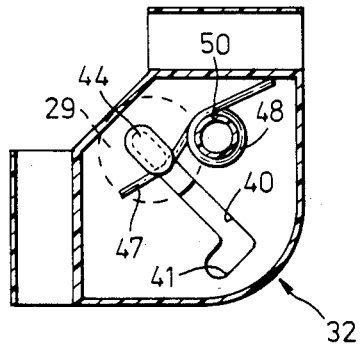
Fig. 4.
Fig. 5.
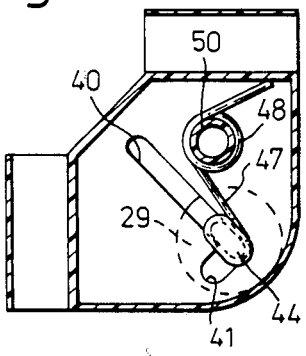
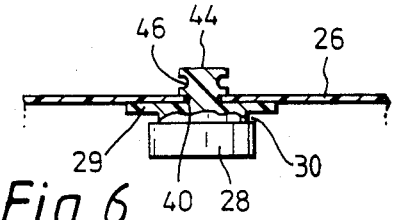
Fig. 6.

TENSIONING OF FLEXIBLE SHEETS ACROSS FRAMES

FIELD OF INVENTION

This invention relates to the tensioning of flexible sheets across frames. The invention is particularly, but not exclusively, concerned with the tensioning, across display frames for use in showrooms, exhibitions, etc., of flexible sheets bearing, for example, printed advertising material or like, which sheets may, for example, comprise paper or card laminated with transparent plastics material.

SUMMARY OF INVENTION

It is an object of the invention, in one of its aspects, to provide an improved method of supporting a flexible sheet in tension within a space bounded by a peripheral frame.

According to this aspect of the invention there is provided a method of supporting a flexible sheet in tension within a space bounded by a peripheral frame, the method including providing, on said frame, tensioning devices each including a sheet engaging element for engagement with a peripheral portion of the sheet, and means for moving said element towards and away from the middle of said space bounded by the frame, the method further comprising engaging said sheet with said sheet engaging elements whilst the latter are in their positions closest to the middle of said space and subsequently causing or allowing said sheet engaging elements to move away from the middle of said space towards the peripheral frame to tension the flexible sheet within the frame.

It is an object of the invention, in another of its aspects, to provide an improved device, for example a display device, including a peripheral frame bounding a space and a flexible sheet extended across said space in tension.

According to this aspect of the invention there is provided a device including a peripheral frame bounding a space, and a flexible sheet extended across said space and supported in a tensioned condition by means of tensioning devices carried by the frame, each tensioning device including a sheet engaging element engaged with a respective peripheral portion of the sheet, said element being movable towards and away from the middle of said space, the device including means urging said element in the direction away from the middle of said space, or holding said element against movement toward the middle of said space, to hold the sheet in tension.

According to a yet further aspect of the invention there is provided a sheet tensioning device for use in supporting a flexible sheet in tension across a space bounded by a frame comprising an elongate member or members extending around the periphery of said space, the sheet tensioning device including a body having means for engaging such a peripheral member, and a sheet engaging element mounted in said body for movement towards and away from said means.

BRIEF DESCRIPTION OF DRAWINGS

The accompanying drawings show embodiments of the invention, by way of example.

In the drawings:

FIG. 2 is a fragmentary elevational view of a portion of the device of FIG. 1 showing a sheet-tensioning device embodying the invention, FIG. 3 is a view, partly in section, on the line III—III in FIG. 2, FIG. 4 is a view in section along the line IV—IV of FIG. 3, FIG. 5 is a view, similar to FIG. 4, but showing the sheet-tensioning element in another position, and FIG. 6 is a sectional view of a detail of the sheet-tensioning device.

DESCRIPTION OF PREFERRED EMBODIMENTS

Figure 1:
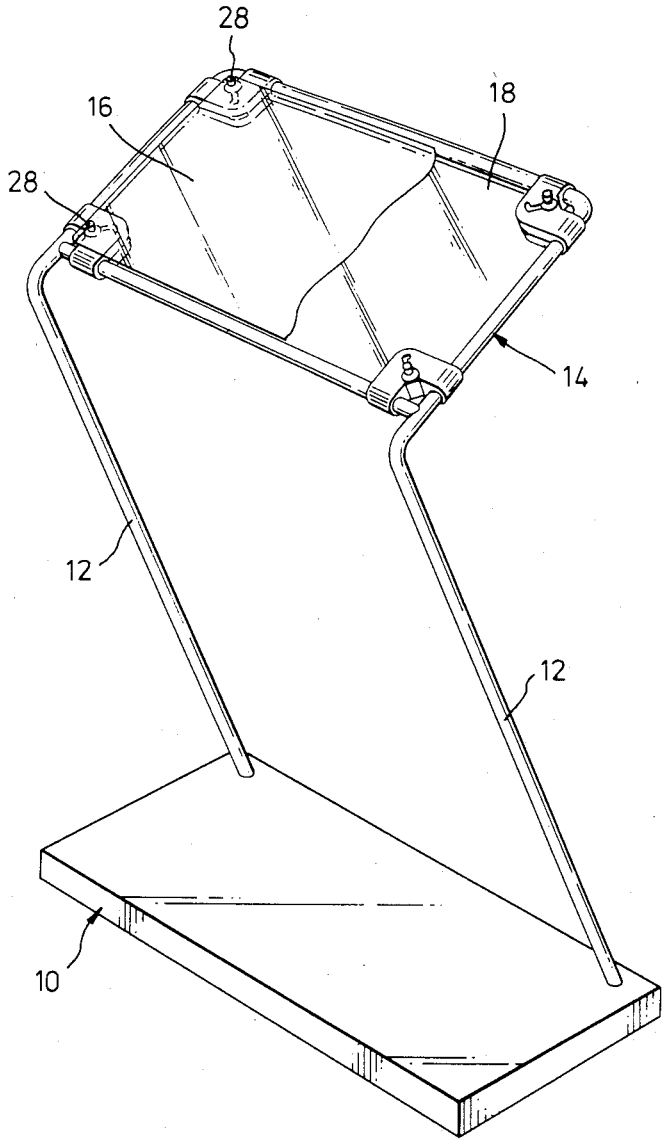
FIG. 1 is a perspective view showing a display device embodying the invention.

The display device shown in FIG. 1 comprises a base 10 in the form of a rectangular slab from which extend upwardly, and inclined forwardly, parallel side members 12 carrying at their upper ends an integral rectangular frame 14, the plane of which is inclined upwardly in the opposite sense from the frame members 12, the arrangement being such that the rectangular frame 14 is supported at such a level, and at such an angle that a sheet of advertising material or the like supported in the frame as explained below is disposed so as to be conveniently viewable by a person standing in front of the device. The device shown in FIG. 1 may, for example, be disposed in front of an exhibit at an exhibition or in front of an article, for example a motor vehicle, in a showroom or the like, the sheet supported in the frame 14 bearing, for example, material relating to the exhibit or article concerned.

In the preferred embodiment shown, the frame 14 in fact carries two parallel sheets bearing display material, namely an upper sheet 16 and a lower sheet 18, the upper sheet 16, for purposes of illustration, being shown partly cut-away in FIG. 1. The sheets 16, 18 are conveniently of sheet or card laminated with transparent plastics material, i.e. having layers of transparent plastics material bonded to their faces and affording the surfaces of the sheet, and the sheets are held in a tensioned condition within the space bounded peripherally by the frame 14 by tensioning devices to be described below. The members 12 and frame 14 are, in the embodiment shown, made of round metal rod appropriately bent and welded to the form shown.

FIG. 2 shows one of the upper corners of the frame 14, with the sheets 16, 18 omitted, and shows a sheet-tensioning device 20 mounted in the corner of the frame. A corresponding device 20 is mounted in each of the other corners of the frame, the devices 20 serving to hold the sheets, 16, 18 in tension in the frame 14.

The device 10 includes a hollow body 22, for example of synthetic plastics material affording, extending at right angles to one another, two sleeves 24 through which extend, as a snug fit, respective ones of the two mutually perpendicular sides **14*a*, 14*b* of the frame which meet in the corner at which the device 20 is mounted, each sleeve 24 affording, as shown, a cylindrical bore through which extends the respective portion 14*a*, 14*b*. The body 20 provides upper and lower terminal faces 26, 27 which extend approximately in the parallel planes which include respectively the upper and the lower edges of the rod portions defining the four sides of the frame 14. From the upper face 26 of the body 22 extends a cylindrical peg 28 forming part of a first sheet-tensioning element and from the lower face 27 of the body 22 extends a similar peg 28 of a further sheet-tensioning element. Each peg 28 has an outer cylindrical portion, a flange 29 engaging the respective face 26, 27 and a groove extending therearound between the flange 29 and the major cylindrical portion. Whilst this groove may have a simple circular annular form, so that the groove forms a reduced diameter portion of the peg, it is preferred that, as viewed in cross-section (not shown) through the peg, in the region of the groove, the peripheral surface of the groove has the form of two intersecting circular arcs, of equal radius of curvature, corresponding to the radius of the respective aperture (see below) in the sheet 16, 18 through which the peg is to be extended, i.e. slightly greater than the radius of the major portion of the peg 28. The orientation of the intersecting circular arcs is such that when, as explained below, the respective peg is tensioned against the edge of the respective aperture in the sheet, the edge of the aperture bears uniformly over the part of the peripheral bottom surface of the groove which affords one of these circular arcs. Each sheet 16, 18 has, adjacent each of its four corners, a respective circular aperture therethrough which fits over the respective peg 28, the portion of the sheet affording the edge of said aperture being received in the groove 30**.

Each peg 28 is movable diagonally with respect to the frame under spring bias, i.e. along the arrow 32 in the case of the pegs 28 of the device 20 shown in FIG. 2, so that the respective sheet 16, 18 is placed in tension.

Referring to FIGS. 4 and 5, the device 20 effectively comprises two identical portions, on opposite sides of the median plane of the body 22, which is the plane of section indicated by the line IV—IV in FIG. 3. The device 20 may, in fact, be formed as two such identical parts engaging one another along planar faces lying in the median plane of the body 22, although other arrangements may be adopted. For example, the body 20 may be formed as two such identical parts which are, in effect, connected with one another via the wall of one sleeve, which wall is, for example when the body is formed by moulding, originally in an "unrolled" condition and which is bent around the respective limb 14*a*, 14*b* during fitting of the body to the frame. In any case, the two parts of the body are brought together on opposite faces of the frame to embrace the limbs 14*a*, 14*b* during fitting of the devices to the frame, the opposing parts of the body being held together by appropriate means, not shown, for example, by dowel arrangements, integral snap-fastening formations, or even by separately manufactured securing elements, none of which are shown.

The upper and lower surfaces 26, 27 of the body 22 are afforded by respective major walls, which are spaced apart to define therebetween a chamber which accommodates parts of the tensioning mechanism to be described. Each major wall has a slot 40 formed therein extending along a diagonal line which bisects the angle between the sides 14*a*, 14*b* as shown in FIG. 2, and in this slot the respective sheet tensioning element is supported for sliding along the slot. As shown in FIG. 6, which is a fragmentary view in section along the line VI—VI in FIG. 2, each sheet tensioning element includes a stem portion 42 indicated in dotted lines in FIG. 2, which is approximately oblong as viewed in section parallel with the plane of FIG. 2. The stem 42 extends through the slot 40 with its longer dimension extending longitudinally of the slot, the cross sectional dimensions of the stem 42 being such that the stem 42 is freely slidable longitudinally of the slot but is non-rotatable therein. Within said chamber, the stem 42 carries an enlarged root portion 44 which is too large to pass through the slot 40, whereby the sheet engaging member is held captive.

The enlarged root portion 44 has a circumferential groove 46 therein to receive an end portion 47 of a hairpin spring 48 which is fitted upon a boss 50 extending into the chamber from the respective major wall. The end portion 47 acts as a lever rotatable about an axis approximately corres-ponding with that of the boss 50 and bearing upon a cam surface provided by the bottom of the groove 46, the arrangement being such that in the position shown in FIG. 4, the portion 47 acts on the portion of this cam surface which faces toward one end of the slot 40 to urge the sheet-tensioning element along the slots 40 in the direction of the arrow 32, whereas in the position shown in FIG. 5, the end portion 47 bears substantially on the side of the root portion 44 laterally of the slot 40, so that there is virtually no force urging the sheet tensioning element along the slot 40 so that the element will remain in the position shown in FIG. 5 untill displaced manually towards the opposite end of the slot 40, in the direction of the arrow 32.

In use, the devices 20 are first attached to the frame 14 as shown, and the pegs 28 are initially displaced along the slots 40 towards the middle of the space defined within the frame so that the holes at the corners of the respective sheets 16, 18 can be fitted without difficulty over the pegs to engage in the grooves 30.The pegs 28 are then simply displaced manually away from the middle of the space bounded by the frame towards the respective corners so that they move into the regions of their respective slots where the respective springs 48 are effective to urge the pegs 28 further towards the respective corners of the frame, whereby the springs 48 tension the respective sheets 16, 18. The sheets 16, 18 are so formed that, as shown in FIG. 1, the corner portions thereof cover the bodies 22 of the devices and conceal these bodies from view, only the pegs 28 remaining visible on the outer sides of the sheets.

It will be appreciated from FIGS. 4 and 5 that the boss 50 of one half of the tensioning device is positioned in the chamber entirely to one side of the diagonal along which slot 40 extends. The other half of the device 20, being identical, has its boss 50 lying in the chamber on the opposite side of this diagonal. The dimensions of the stems of the pegs 28 within the chamber, measured axially of the pegs, are such that interference between the two pegs is avoided.

It will be noted that each slot 40 terminates, at its end further from the respective corner of the frame 14, in a transverse recess 41. This recess 41 is simply to allow insertion of the enlarged root 44 of the sheet tensioning element (which is preferably formed integrally) during assembly.

It will be appreciated that it is by no means necessary to have a sheet 16, 18 on each side of the frame nor, consequently, a peg 28 on each side of each device 20, and, indeed, in a device such as shown in FIG. 1, only the upper sheet 16 would normally be used. However, the device may also be used in conjunction with vertical rectangular frames intended to be viewed from either side, in which case it may well be desirabe to have a separate sheet 16, 18 on either side of the vertical rectangular frame. Where only one sheet is to be used, pegs 28 may be fitted on only one side of the devices 20.

In particular, the sheet-tensioning means may be used in conjunction with a panel system such as disclosed in our British Pat. No. 1,542,244, or Our patent application 8226563, in which adjacent panel-supporting rectangular frames may be coupled together hingedly with gear-toothed formations carried by the sides of such frames meshing during relative pivoting between such frames. It will be noted that the sleeves 24 have, externally, longitudinally projecting ribs 80 spaced apart circumferentially around each sleeve. These ribs 80 form rudimentary gear teeth so that adjoining sleeves 24 of adjoining devices on adjoining such rectangular frames may mesh together after the fashion of gear teeth during relative pivotal movement between the frames around the axes of the respective sleeves 24.

Figure 7:
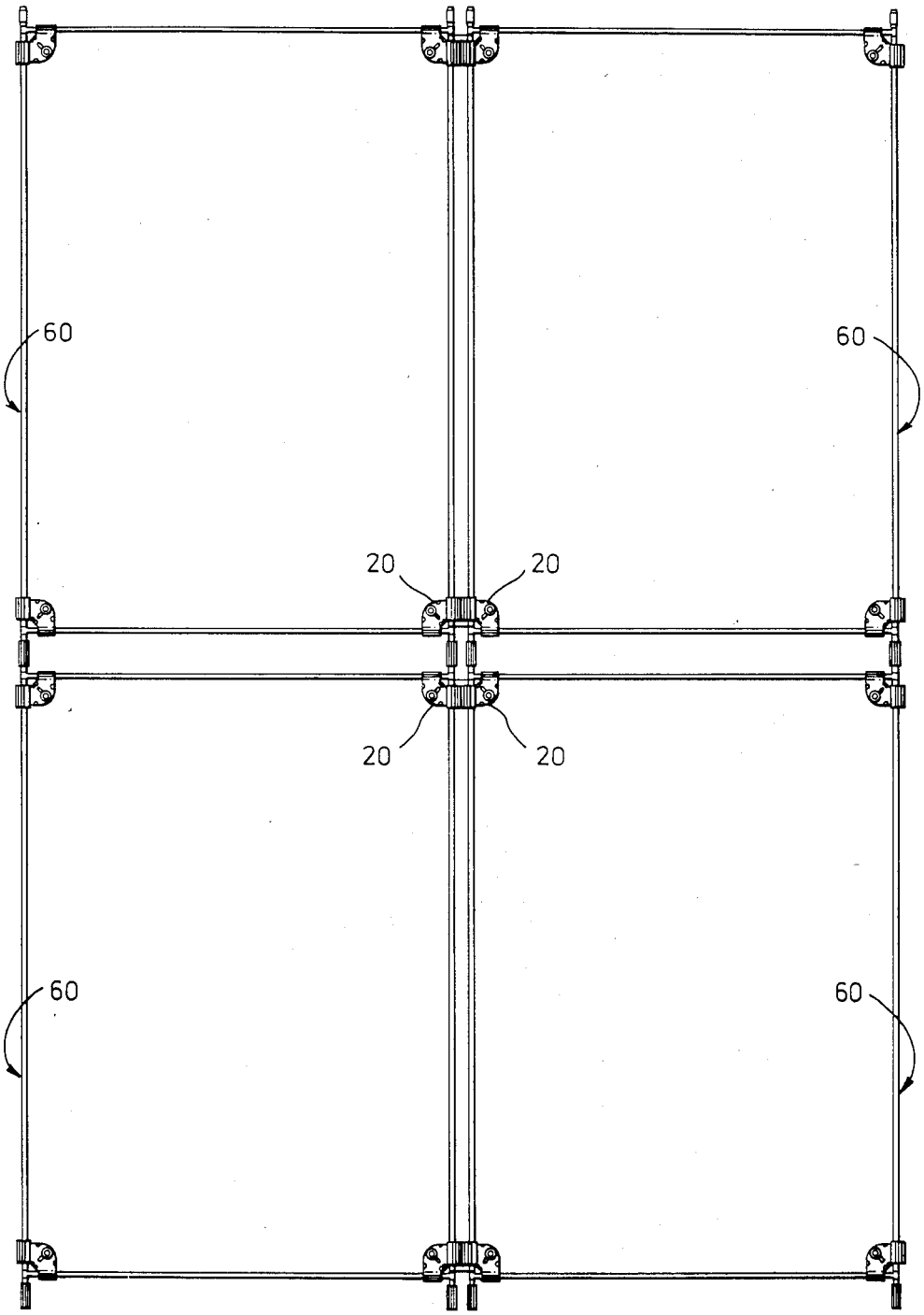
FIG. 7 is an elevation view of another form of display device embodying the invention, and, FIG. 8 is a perspective view, to an enlarged scale, showing a portion, of the embodiment of that figure, with some of the components in a different position.
Figure 8:
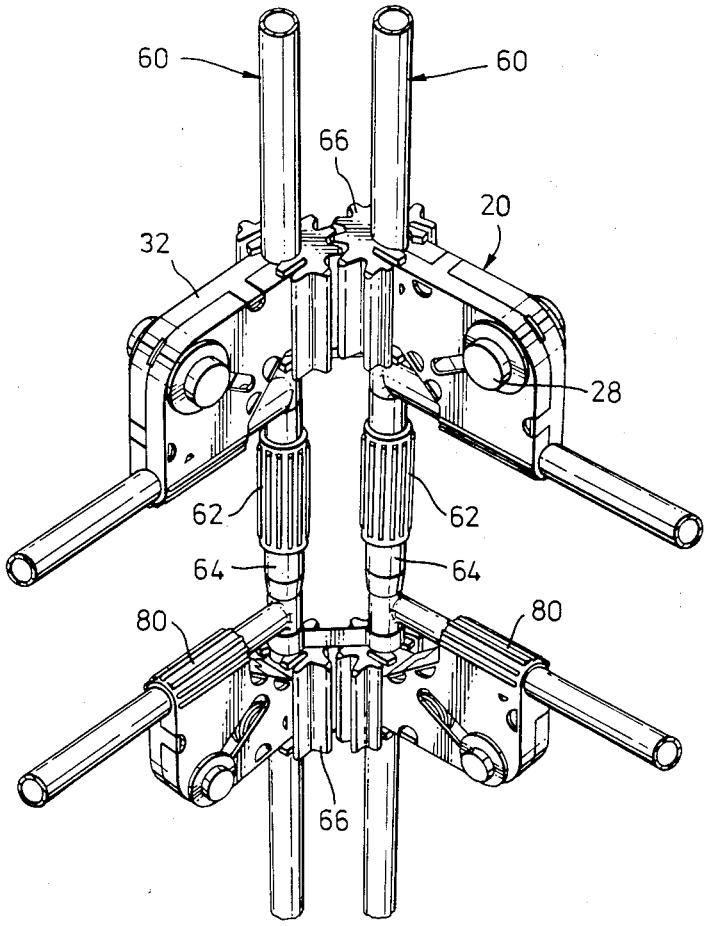

A variant of the last-mentioned arrangement is shown in FIGS. 7 and 8. FIG. 7 shows a panel system comprising a plurality of rectangular frames 60 each having spaced apart parallel vertical side members connected by upper and lower parallel horizontal members. The upper ends of the side members of each frame 60 project upwardly above the upper horizontal member whilst the lower ends of the side members of each frame 60 project downwardly below the lower horizontal member. A plurality of frames 60 may be arranged in a common plane, one above the other, with their respective side members in vertical alignment, the vertically arrayed frames being interconnected by sockets 62 provided on the downwardly projecting parts of the side members of the frame above, receiving spigots 64 provided on the upwardly projecting parts of the side members of the frame below. Laterally adjacent frame members, which are transversely spaced somewhat in this arrangement, are held together by clips.

In the arrangement of FIGS. 7 and 8, instead of the adjoining ribbed sleeves 24 on adjoining side members of adjoining frames meshing directly, each such sleeve has fitted thereover a fitting 66, preferably of resilient plastics having the peripheral form of a gear segment and having internally formations, not shown, to allow it to be retained firmly on the respective sleeve, and it is the respective fittings 66 on adjoining sleeves 24 which mesh together after the fashion of gear teeth during relative pivotal movement between the frames 60 around the axes of the respective sleeves 24.

Whilst the devices shown are intended to be fitted in the corners of a rectangular frame, it will be appreciated that similar devices could be fitted, for example, midway along each side of the frame 14, in which case each sheet-tensioning device may have a body affording only a single rod-receiving sleeve and may have its sheet-tensioning element or elements slidable along corresponding slots extending in a direction perpendicular to the axis of the rod-receiving sleeve.

I claim:

1. A device for supporting a flexible sheet in tension comprising:

a planar peripheral frame bounding a space, said frame comprising a series of elongate side members;

a plurality of tensioning devices carried by the frame, each tensioning device having at least one passage therethrough for receiving at least one of said side members, said tensioning device including a hollow casing having a wall extending parallel with and adjacent to the plane of said peripheral frame, an elongate slot in said wall extending from near said passage receiving said side member towards the middle of the frame and away from said passage;

a movable sheet engaging element slidable within said slot, said sheet engaging element having an outer part projectng from said wall of said casing for engagement with a sheet to be supported, said outer part having a surface engaging the outer surface of said wall, said sheet engaging element further having a stem extending freely through said slot and an enlarged root portion within said casing which is wider than said slot and cooperates with the inner surface of said wall to hold said sheet engaging element captive in said slot while allowing free movement of the sheet engaging element along said slot towards and away from the middle of said space;

a spring fixed within said casing, said spring including a coil portion and an end portion projecting radially from said coil portion, said tensioning device including a boss fixed with respect to said casing and receiving said coil portion to form a pivotal axis for quasi-pivotal movement of said end portion for tensioning and untensioning said spring, said quasi-pivotal movement being in a plane parallel with said wall, said enlarged root portion of said sheet-engaging element having a groove therearound in which said end portion locates, said end portion, in a relatively unstressed state of said spring engaging a side of said root portion when said sheet engaging element is positioned adjacent said frame within said slot, said leg portion, in a relatively stessed state of said spring, engaging a cam surface on the bottom of said groove in said root portion when said sheet engaging element is positioned towards the middle of said space within said slot whereby force from said spring substantially laterally of the slot so that, in the absence of externally applied forces, said sheet engaging element is retained against movement along said slot;

said sheet engaging elements of said tensioning devices movable within said slot against said spring from a position nearer the middle of the space, where a sheet will not be in tension, to a position away from the middle of the space, where a sheet is held in tension by the aggregate effect of the spring bias of said springs on said sheet.

2. A device according to claim 1 wherein said surface of said outer part engaging said outer surface of said wall comprises a flange on said outer part lying against said casing wall, and wherein said outer part further comprises at least one peg extending from said flange outwardly from said casing for extending through a hole in a sheet to be supported.

3. A device according to claim 2 wherein a groove is formed in said peg adjacent said flange, said groove extending longitudinally in the circumferential direction of said peg for receiving the edge of a hole in the sheet to be supported.

4. A device according to claim 2 wherein each said tensioning device includes two said pegs, projecting from opposite faces of said casing, each of said pegs independently movable in said casing.

5. A device according to claim 1 wherein said tensioning devices have two passages therethrough, said passages at right angles to each other for receiving adjacent, perpendicular sides of said frame.

6. A device according to claim 1 wherein said casing comprises two identical parts engaging one another along planar faces lying in a medium plane of said tensioning devices.

7. A device according to claim 7 wherein said slot bisects the angle between said adjacent, perpendicular sides.

* * * * *